US005078290A

United States Patent [19]

Ochs

[11] Patent Number: 5,078,290

[45] Date of Patent: * Jan. 7, 1992

[54] CONTAINER CLOSURE WITH INTERNAL CHANNELS FOR WASHING AN INTERTHREAD SPACE

[75] Inventor: Charles S. Ochs, Lancaster, Ohio

[73] Assignee: Anchor Hocking Packaging Company, Lancaster, Ohio

[ * ] Notice: The portion of the term of this patent subsequent to Apr. 23, 2008 has been disclaimed.

[21] Appl. No.: 566,239

[22] Filed: Aug. 15, 1990

Related U.S. Application Data

[63] Continuation-in-part of Ser. No. 402,211, Sep. 1, 1989, abandoned, and a continuation-in-part of Ser. No. 535,400, Jun. 8, 1990, Pat. No. 5,009,324.

[51] Int. Cl.[5] ..... B65D 45/32

[52] U.S. Cl. ..... 215/276; 215/274; 215/350; 215/351; 215/252

[58] Field of Search ..... 215/276, 274, 273, 309, 215/350, 351

[56] References Cited

U.S. PATENT DOCUMENTS

| | | | |
|---|---|---|---|
| 1,160,597 | 11/1915 | Hammer | 215/276 |
| 2,008,593 | 7/1935 | Pedersen | 215/276 |
| 2,105,031 | 1/1938 | Enkur et al. | 215/230 X |
| 2,270,729 | 1/1942 | Geddes . | |
| 2,449,014 | 9/1948 | Shaffer . | |
| 2,456,607 | 12/1948 | Shaffer . | |
| 3,110,599 | 11/1963 | Kusinski et al. | 215/274 X |
| 4,093,094 | 6/1978 | Smalley et al. | 215/276 |
| 4,121,729 | 10/1978 | Husum | 215/276 |
| 4,408,694 | 10/1983 | Mueller | 215/276 |
| 4,643,330 | 2/1987 | Kennedy . | |
| 4,694,969 | 9/1987 | Granat | 215/274 X |
| 4,705,183 | 11/1987 | Moloney | 215/276 |
| 4,721,219 | 1/1988 | Dullabaun et al. | 215/274 |
| 4,747,502 | 5/1988 | Luenser . | |
| 4,807,770 | 2/1989 | Barriac . | |
| 4,832,214 | 4/1989 | Schrader et al. . | |
| 4,880,127 | 11/1989 | Doi . | |

*Primary Examiner*—Stephen Marcus
*Assistant Examiner*—Vanessa Caretto
*Attorney, Agent, or Firm*—Wood, Herron & Evans

[57] ABSTRACT

A closure is provided with channels through which wash water can be injected to wash out food particles between the threads of a container after the closure has been applied and sealed. In a composite closure embodiment, a lid or insert disk is received in an annular shell beneath an overhanging top lip of the shell. Water wash channels are provided on the undersurface of the top lip, and extend from the inner edge of the lip outwardly past the edge of the disk. One or more stops on the underside of the top lip prevent the channels from being closed, as by over-tightening. The wash channels extend outwardly past the stop, and communicate with a spiral channel in the threaded region of the shell, which in turn communicates with an outlet. A water jet directed onto the lid of the closure flows through the wash channels outwardly over the edge of the lid and downwardly into the threaded region, to an outlet.

7 Claims, 3 Drawing Sheets

CONTAINER CLOSURE WITH INTERNAL CHANNELS FOR WASHING AN INTERTHREAD SPACE

RELATED APPLICATIONS

This application is a continuation-in-part of my pending applications Ser. No. 402,211, filed Sept. 1, 1989, now abandoned and Ser. No. 535,400, filed June 8, 1990, now U.S. Pat. No. 5,009,324.

FIELD OF THE INVENTION

This invention relates to container closures, and more particularly to a closure with means by which food product on the threads of a container can be washed from them even after the closure has been sealed.

BACKGROUND OF THE INVENTION

In the food packing industry, when a food product (for example, baby food) is packed in a container, it sometimes happens that a small amount of the food product will splash onto the finish or threads of the container during the packing and sealing process. The food product may spoil if it remains between the closure and the container, but usually any such spillage is removed by water washing or a cooling spray. The containers of food products which are packed hot are washed as an incident to water spray cooling, and the containers of products which are retorted are immersed in water during the retort cycle. However, such water washing and/or cooling does not always remove food product that might have been lodged on threads in the area between the closure and the container, and any such residual product could present a potential problem. Thus there has been a need for a closure in which the threaded region between the closure and the container can be washed or flushed clean, after the closure has been applied.

The problem is accentuated where the closure is of the type which includes a tamper evidencing or breakaway band, such as a band which is severed and separated from the upper or top part of the closure as an incident to opening. The reason for this is that tamper indicating bands typically include inward, up-turned tabs or flaps which project beneath a locking bead around the neck of the container below the container threads. The up-turned tabs or flaps present pockets into which food particles can be lodged and retained, which tends to accentuate the need for effective cleaning.

THE PRIOR ART

Geddes U.S. Pat. No. 2,270,729 shows a two-piece closure with a shell having an inturned flange at the top and radial corrugations for strengthening the flange. The inner edge of the flange is planar and not corrugated. This structure is said to maintain a hermetic seal by preventing the flange from bending upwardly. The patent does not discuss water washing.

Shaffer U.S. Pat. No. 2,449,014 shows a two part closure wherein a threaded band which receives a lid has an overhanging flange with a bead at its inner edge. The band is interrupted by offsets at spaced positions. Steam or water can be circulated between the inside of the band and the outside of the lid and the outer surface of the container to remove food particles.

Shaffer U.S. Pat. No. 2,456,607 shows a closure having wash channels between a shell and a liner which is permanently retained within the shell, to enable the space between the shell and liner to be washed and sterilized when the closure is off the container. The closure does not provide for internal washing when secured on a container.

Barriac U.S. Pat. No. 4,807,770 shows a composite closure having a plastic ring or band for the purpose of indicating vacuum in the container, wherein the band contains notches in its top lip and side wall. The band receives and retains a generally flat disk which engages and closes the top of the container. Washability is not disclosed.

Doi U.S. Pat. No. 4,880,127 shows a composite closure having fine projections on the inner side of an annular top panel wall of an outer lid. The projections provide gas paths between the inner and outer lids and upwardly release gas pressure when a carbonated beverage container is first being opened. Compression of plastic closure threads is said to maintain airtightness between the threads of the closure and the container; such airtightness prevents water washing of the threads.

BRIEF DESCRIPTION OF THE INVENTION

In accordance with this invention, a closure is provided with wash channels which provide a water flow path into and through an interthread channel—an open spiral shaped channel between the thread of the container and the thread of the closure—from the top to bottom thereof. The invention can be used in a composite (two-piece) cap with either a bottom loaded insert disk or a top loaded disk, as well as in a molded one-piece closure.

As used in a composite closure with a bottom loaded insert disk, the closure shell is provided with one and preferably more angularly spaced water wash channels which extend outwardly between the insert disk and a top lip which overhangs the disk. These channels start at the inside edge of the top lip and communicate with the threaded region of the shell. A downwardly projecting stop or boss on the underside of the lip will abut the disk to prevent it from closing the channels, for example if the closure is overtightened. The channels on the closure shall preferably extend outwardly beyond the edge of the disk, down the inside wall of the skirt of the shell. Inwardly projecting ribs on the inside of the skirt help to center the disk, and the channels between the ribs provide for wash downflow around the entire circumference of the disk even if the disk is slightly off center in the shell. The thread of the closure forms a spiral interthread channel with the thread of the container. A wash jet directed onto the insert disk will flow over the disk, around or past the stop and over the peripheral edge of the disk, downwardly into the threaded region in which the wash spirals downwardly along and between the threads of the closure and the container. The water flows to and through an outlet from the closure, below the threaded region. If a tamper evidencing band is provided, drain outlets are preferably provided along the juncture of inturned band retaining means and the tamper indicating band.

In preferred form, only a small fraction of the area of the undersurface of the top lip of the closure actually bears on the insert disk as a stop; the flow channels extend over most of the area between the disk and top lip. A slotted rim surrounds the top opening; a jet of wash water can pass through the slots in the rim, into a recess or chamber on the undersurface of the lip, then outwardly through channels over the lip rim and down side channels into the interthread space.

In another embodiment, a closure having wash channels is further provided with a bead which temporarily closes the channels at the time when the vacuum is broken, so as to prevent dirt on the insert disk from being carried into the container by the inrush of air when the vacuum is broken. At other times the bead is spaced from the disk and does not interrupt wash flow.

DESCRIPTION OF THE DRAWINGS

The invention can best be further described by reference to the accompanying drawings in which.

DETAILED DESCRIPTION

Figure 5:
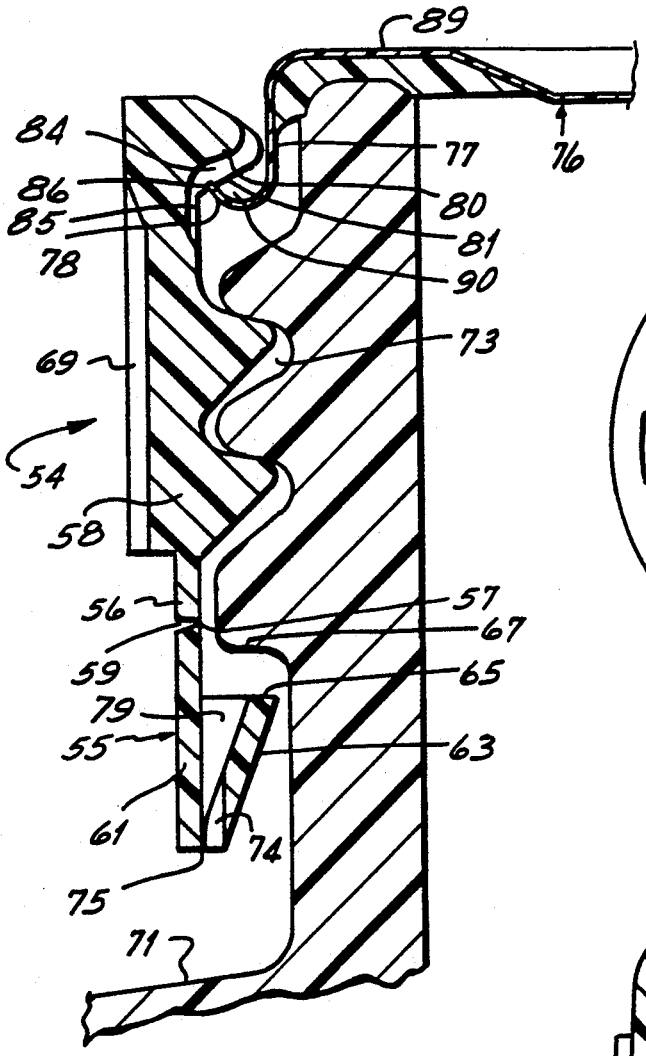
FIG. 5 is an enlarged vertical section of a composite closure with a top-loaded disk and a tamper evidencing band which is provided with wash channels in accordance with a second embodiment of the invention.
Figure 6:
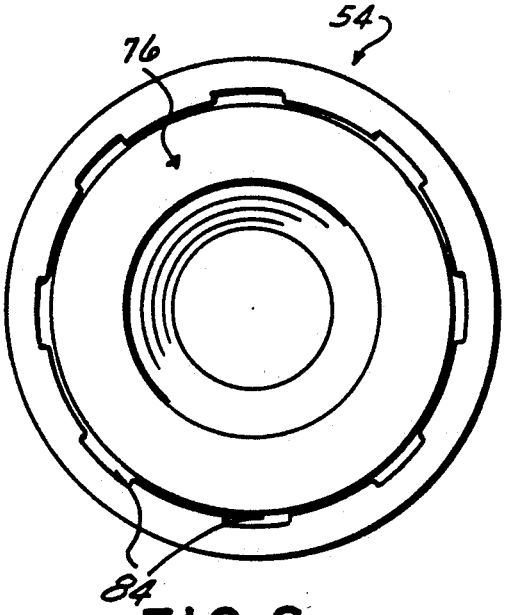
FIG. 6 is a top plan view of the closure of FIG. 5.
Figure 7:
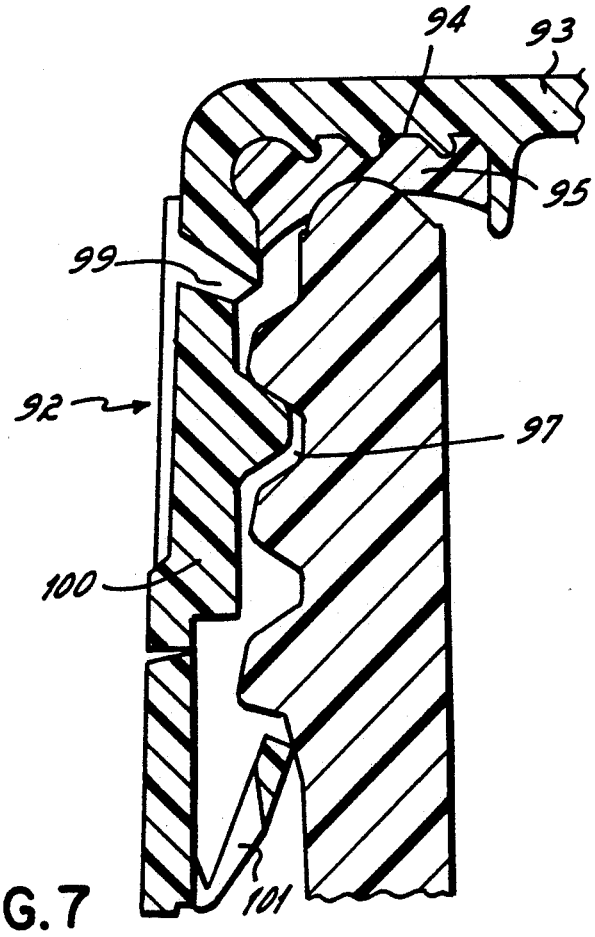
FIG. 7 is an enlarged partial vertical section of a one-piece closure in accordance with a third embodiment of the invention.

The invention is useful in closures which do not have a tamper indicating band, but is especially useful in those which do. An embodiment of the invention in a composite closure having no tamper indicating band is shown in FIGS. 1–4; an embodiment of the invention for use in a closure with a tamper indicating band is shown in FIGS. 5–7.

Figure 1:
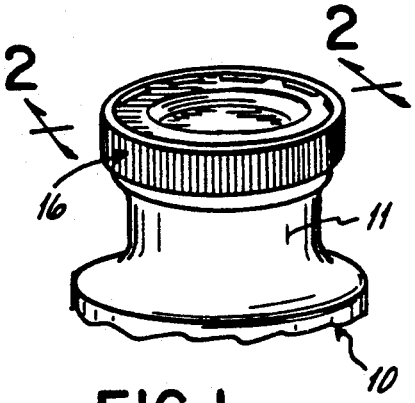
FIG. 1 is a fragmentary perspective view of the neck of a container with a composite closure in accordance with a first embodiment of the invention.
Figure 4:
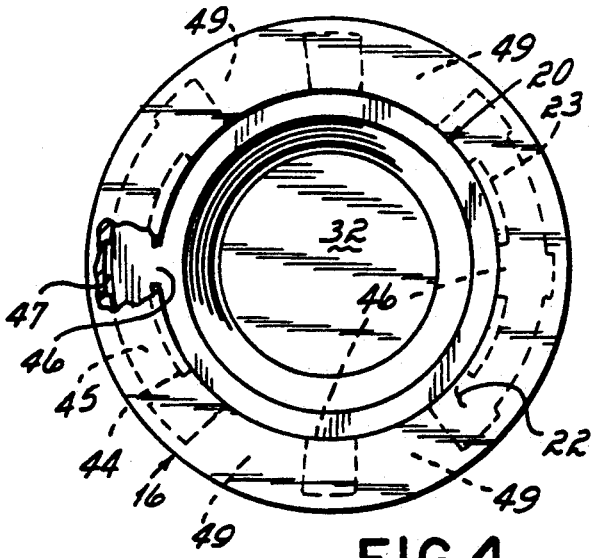
FIG. 4 is a top plan view of the closure of FIG. 2, partly broken away, showing the slotted rim and water channels of the closure.
Figure 2:
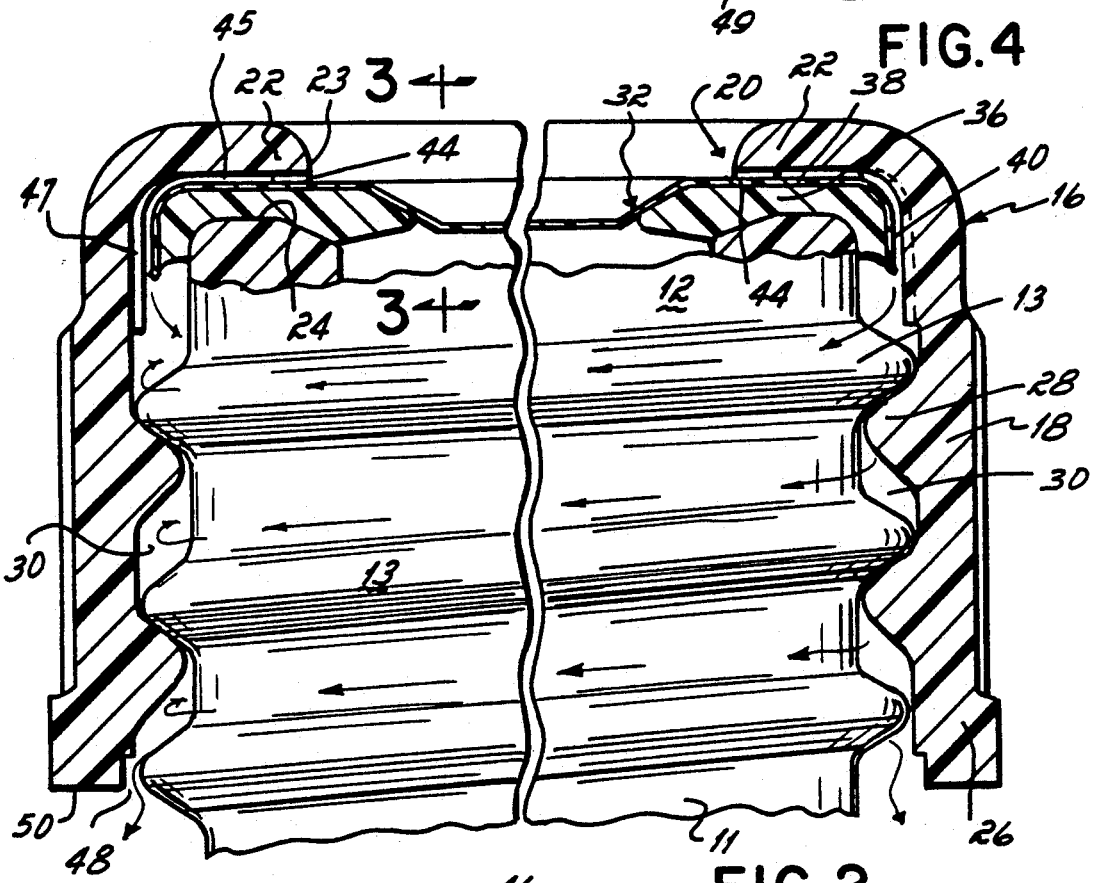
FIG. 2 is an enlarged vertical axial section taken on line 2—2 of FIG. 1, and indicates diagrammatically the flow of wash water through the wash channels from the top downwardly around the threads.

Referring to the drawings in more detail, a container designated generally by 10 has a neck 11 and a finish 12 (FIGS. 1 and 2). Container 10 may be of glass or of molded plastic. The embodiment illustrated has "two start" threading, that is, the container has two helical threads 13 which cooperate with two internal threads 28 of the closure 16, but it will be understood that the invention is also useful with containers having a single thread, or having interrupted screw lugs. As used herein the term "thread" is used to mean and include both a screw thread and discontinuous lugs.

The closure designated generally by 16 includes an annular shell 18 which has a top opening 20. Closure shell 18 may be an integral molding of plastic. An annular top lip 22 projects inwardly, above the top edge 24 of container 10, and defines the peripheral edge of top opening 20. The side wall of the closure shell 18 includes a generally cylindrical skirt portion 26. As can be seen in FIG. 2, when the closure is secured on container 10 the threads 28 of the closure bear on the underside of the respective threads 13 of the container, but the closure threads do not completely fill the spaces between the container threads, so that an interthread space or flow channel 30 is presented between the threads of the closure and those of the container. This interthread channel is in the form of an open ended, internal spiral passage between the skirt and the container.

Top opening 20 of the closure is closed and sealed by a lid or insert disk 32 which is retained within shell 18 by the top lip 22 thereof. Disk 32 may comprise a metal or composite member having a downwardly opening groove or recess 38 for receiving a gasket 36 on its lower surface. Preferably but not necessarily disk gasket 36 may be a flowed-in plastisol gasket. Around its periphery, disk 32 has a down turned rim 40, see FIG. 2. The disk 32 is spaced above the top of the container by the gasket 36 and does not necessarily contact the container on either its top or its side surface. In this first embodiment the disk is inserted from the bottom of the closure ("bottom loaded"); but as will be described the invention is also useful with a disk which is loaded into a shell from the top.

After container 10 has been filled with food product and the closure is being applied, closure top lip 22 engages disk 32 and gasket 36 is brought into engagement with the top edge of a container. After retorting, or after the container has been chilled, the air pressure in the container beneath the disk is lower than the external air pressure acting downwardly on the surface 32, and the pressure differential holds the gasket tightly against the container to seal it. The top lip 22 does not necessarily provide the seal.

As previously indicated, it sometimes happens that a bit of food product splashes on the outside of the container and may be lodged on the side wall or the threads, where it can spoil. It is therefore desirable to wash the interthread channel 30 after the closure has been applied. Absent this invention, top lip 22 and/or the screw threads would effectively isolate any food particles on the threads. The invention provides a pathway through which a water wash, directed onto the top of the disk, can flow from the top of the disk downwardly between the threads, and drain at the bottom of the closure. For this purpose one or more water channels or recesses 45 are provided on the lower face of lip 22, which provide internal flow paths from the top of the disk into the interthread space. (The channels 45 may be shaped to direct or funnel flow diagonally outwardly across the disk, although this does not seem particularly helpful in practice.)

Figure 3:
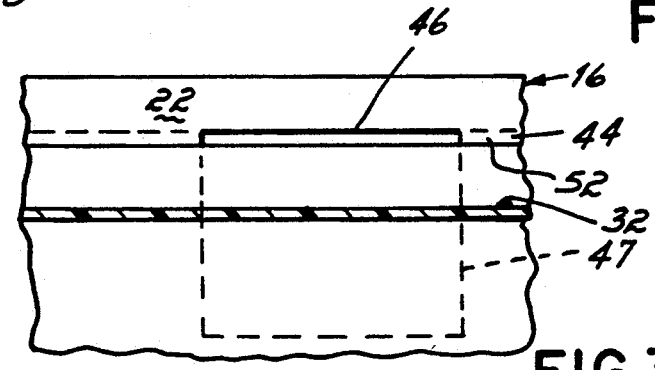
FIG. 3 is a fragmentary, further enlarged vertical view taken on line 3—3 of FIG. 2.

A low, slotted peripheral rim 44 depends from the inner edge 23 of top lip 22. Notches or slots 46 in rim 44 permit water to flow past the rim into channel 45. As shown in FIG. 3, the rim slots 46 are preferably rectangular, as seen in elevation. Their proportions are not critical but may for example be about 0.010"×0.200"; the minor dimension of slots 46 is preferably so small as to prevent entrance of insects into the channels 45. The slots are preferably no larger than necessary to permit wash water from a jet to pass through them. As can be seen, the slots 46 are preferably only barely visible from above. This appears to be psychologically desirable; moreover, they are so small as not to catch or hold most particulate matter that falls on the cap, for example, during shelf storage, or to admit insects.

The channel 45 extends radially outwardly as slots or grooves 47 beyond the downturned disk rim 40 and downwardly on the inside face of shell 18, into the interthread channel 30. It can thus be seen that slots 46 admit water directed onto the disk to flow past edge 23 into chamber 45, radially and to some extent peripherally around the disk (see FIG. 4), and through sidewall grooves 47 in shell 18 into the interthread region 30. The sidewall grooves 47 permit downward flow around the circumference of disk 32 even if it is somewhat off center in shell 18. In the interthread region 30, the wash can flow along and between the threads as indicated by the arrows in FIG. 2, downwardly to wash virtually the entire area between the threads except where the threads of the closure actually bear on the closure threads. A drain opening or gap 48 is provided adjacent the lower edge 50 of the shell, and can simply be a space between the shell and closure neck 11, from which the wash water can exit from the interthread space and carry with it any removed food particles. Tests have demonstrated that a stream of wash water will pass through the slots 46 to effectively wash the interthreaded region.

It is preferred that the water slots be so small as to be effectively open only when heated by hot water (or steam) wash. For that purpose the passages may be so dimensioned that they are normally closed, and so that they open by a differential between the thermal expansions of the shell and the disk when the closure is heated (a plastic shell expanding more than a metal disk). This optional feature is described at greater length in my previously mentioned application Ser. No. 535,400, to which reference may be had.

Because the top lip is attached to the shell only at its outer edge, it may bend upwardly when the shell is tightened on the disk. One or more downwardly projecting stops or bosses 49 are provided on the lip, which acts as a positive spacer to prevent deformation on overtightening from choking or closing the water channels. A stop 49 is preferably positioned substantially directly above the upper end of each closure thread 28. Surprisingly, this stop orientation provides the greatest resistance to lip deformation when the closure is tightened; the bending stress on the lip which tends to block the channel is greatest directly above the start of a thread, and positioning a stop above the upper end of the thread more effectively resists such blocking. If single start threading is used, a stop should be directly above the thread top end. For two start threads, a stop should be provided above each thread start (see FIG. 4). A water channel 45 may extend across the stop.

Referring next to the embodiment of the invention in a closure which includes a top loaded disk and a tamper indicating band, the closure 54 of FIGS. 5 and 6 includes a tamper indicating band 55 around the lower edge 56 of a shell 58. Band 55 is connected to the shell only by severable or rupturable bridges, one of which is shown at 57, there being an interrupted knife cut or score 59 between band 55 and lower edge 56 of shell 58. Band 55 includes an external band or ring 61 with an upwardly molded retaining flap or hoop 63 having an upper inner edge 65 which resides beneath a locking bead 56 around the container. When the closure 54 is unscrewed by applying torque to grips 59, the entire closure initially moves upwardly. When the upper end 65 of hoop 63 bears upwardly against locking bead 67, this exerts a separating force on band 55 and causes the bridges 57 to rupture. Band 55 remains loosely captured on the container between bead 67 and shoulder 71, and thereby provides a distinct visual indication that the closure has been opened. Water outlet windows 74 are molded along the line 75 between flap 63 and band 55. Wash water from interthread chamber 73 empties into the V-shaped space 49 between upturned flap 63 and tamper indicating band 55, and drains from the windows 74.

In the top load embodiment of FIG. 5, the insert disk 76 has a downturned skirt 77 with a reversely or upturned rim 78. The shell 58 has a central opening which is surrounded by an inwardly and then reversely tapered top lip 80. Disk 76 is inserted into the shell by pressing it downwardly past lip 80, until disk rim 78 snaps under the lip and engages against its sloping undersurface 81. Radial water channels 84 are molded in the undersurface 81 of top lip 80, extending across the line of engagement 86 of disk rim 78 with top lip 80 and may extend further down the inside wall 85 of the shell. The channels 84 are of sufficient depth that the disk edge, though it may press into the top lip, does not close the channels. (Bosses or stops are generally not necessary where the insert disk is top loaded.) Thus water directed onto the top 89 of disk 76 falls into the annular pocket 90 between skirt 77 and rim 78, and flows through channels 84 over the top of rim 86, through channels 85 to the interthread space 73. From space 73 the wash flows out through outlet windows 74.

In the one-piece or all plastic closure embodiment of FIG. 7 the top or cover is integral with the skirt 100. More specifically, the closure 92 has a top panel or cover 93 with a channel 94 on its inside face which contains an annular gasket 95. In this embodiment wash water is directed into the spiral interthread space 97 from the outside of the closure below the gasket, rather than across the periphery of a separate top disk above a gasket. Inlet openings 99 are provided at angularly spaced positions around skirt 100, above interthread space 97. Wash water directed into these flows around the threads and drains through outlet openings 101 which, as shown in FIG. 7, may be in a tamper indicating band as already described.

Closures for vacuum sealed containers must effectively prevent dirt on the lid from being sucked into the container by the inrush of air when the vacuum is broken. In theory, dirt on the lid might be blown over the edge of the lid, inwardly past the gasket and into the container upon opening. There is also a possibility that dirt lodged in a tamper indicating band could be carried upwardly as the vacuum is broken, past the gasket and into the container. In the closure embodiments thus far described, the wash channels could in theory provide such a pathway in which dirt might be carried from the top of the lid through the slots, around the lid edge and into the container when the vacuum is broken.

Figure 8:
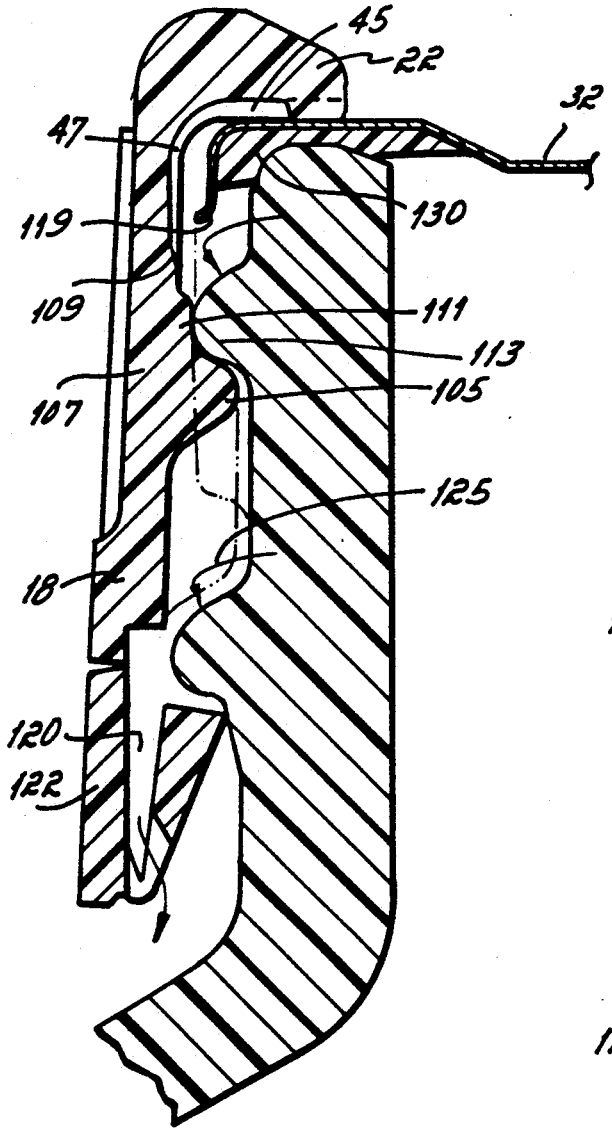
FIG. 8 is an enlarged partial vertical section of a closure in accordance with another embodiment, the closure being secured on a container.
Figure 9:
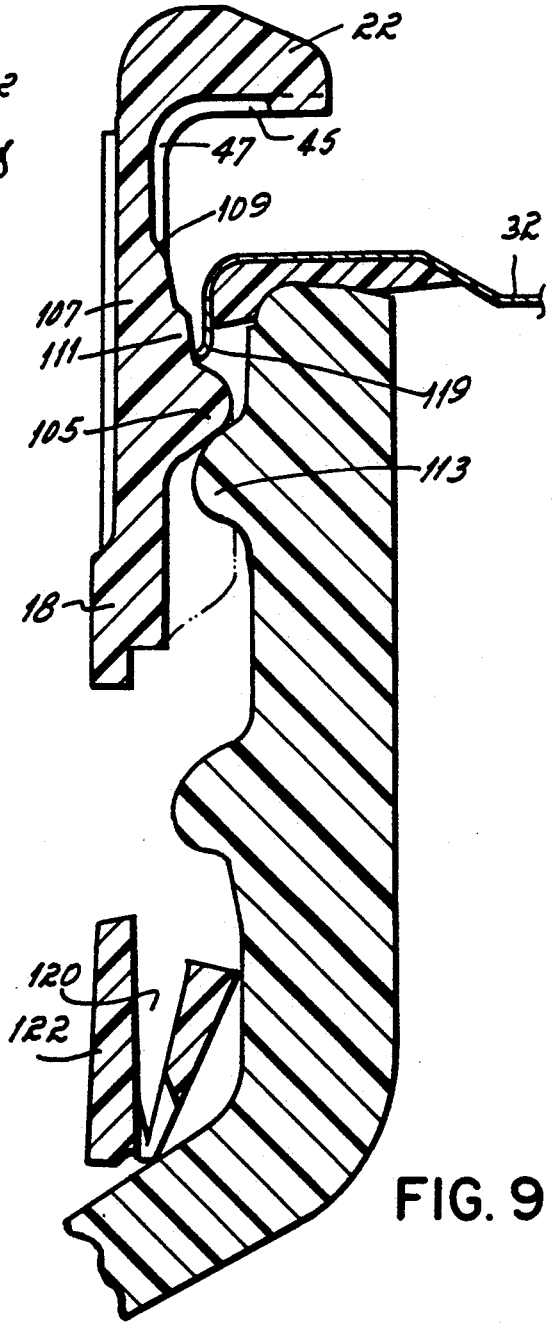
FIG. 9 is a view similar to FIG. 8 but shows the closure after the it has been partially unscrewed to break the tamper indicating band before the lid has been lifted.

FIGS. 8 and 9 show a modified embodiment of the invention wherein the wash channels are automatically choked off at the lid periphery or edge when the lid is lifted by unscrewing the shell, to prevent any such contamination. In this embodiment the closure has a top lip 22 as in the previous embodiments, with water channels as previously described. The grooves 47 extend downwardly on the inside surface of the shell 18 toward the uppermost thread portion 105 on the closure skirt 107.

Below the lower end 109 of each groove 47, and below the lower edge 119 of lid 32, skirt 107 has a continuous internal circular bead or rib 111 which extends annularly around its inside surface. This rib 111 has an inside diameter just equal to the outside diameter of edge 119 of lid 32 (see FIG. 9), so as to form a seal with the lid edge when in vertical alignment with it. When the closure has been tightened on the container, rib 111 is spaced below lid edge 119, as shown in FIG. 8. Rib 111 is then opposite the topmost thread portion 113 of the container, but because the container threads are helical and bead 111 is planar, the bead only contacts the container thread 113 at one point per thread. (Thus, in a container having two thread entrances, the bead 111 contacts the container threads at only two relatively narrow angular areas.) At other angular locations the bead 111 down not engage either the container threads or the closure threads, and wash water can flow downwardly through the opening between them, as indicated by arrows 125 in FIG. 8.

When the closure is unscrewed, the rotation of shell 18 shifts rib 111 upwardly relative to lid edge 119. The lid is lifted and the vacuum is broken by the top portion 105 of the closure threads which abuts lid edge 119 as the shell is unscrewed. (This occurs after the tamper evidencing band has been broken.) Bead 111 is so positioned that, when the shell begins to lift the lid, the bead meets and forms an effective seal with the lid edge around its entire periphery. This seal closes the previous passage between the lid and the shell and thus then isolates the gasket 130 from any dirt on the top surface of the lid.

The embodiment shown in FIGS. 8 and 9 has a tamper evidencing band which is molded in a down position, then is turned up for use. As can be seen, opening the closure first breaks off the band 122, which drops down onto the shoulder of the container, before the lid is lifted. Any dirt in the pocket 120 between the tamper indicating band 122 and the retaining hoop 125 is thereafter so far away from the gasket area that it cannot be drawn into the container as the vacuum is broken. While the invention is not limited to use with a band, a preferred form of downwardly molded, upturned tamper indicating band is shown in the copending application of Thomas H. Hayes, titled "Tamper Indicating Closure Having Retaining Hoop With Relief Windows," Ser. No. 401,966, filed Sept. 1, 1989.

Closures with slots for water washing in accordance with this invention can also include a capability for venting excess gas pressure within the container beneath the lid. Such closures are described and claimed in my copending application Ser. No. 402,211, titled "Pressure Venting Closure", filed Sept. 1, 1989, to which reference may be made.

Having described the invention, what is claimed is:

1. A closure for a container, said closure comprising a plastic annular shell having a top opening and an insert disk beneath said top opening, said shell including a skirt and a top lip which surrounds said opening, said skirt having a threaded region with at least one thread for securing the closure onto the finish of a container, said threaded region providing a spiral interthread channel between said thread of said closure and a thread of a container when said closure is secured thereon, through which channel wash water can flow downwardly, said disk fitting in said shell and retained by said top lip, said disk including a gasket for engaging and sealing the rim of a container, said top lip having an undersurface which faces a peripheral region of said disk, said top lip having at least one water inlet channel molded on its said undersurface through which water can flow beneath said lip and outwardly over the periphery of said disk, said inlet channel communicating with said spiral channel even when said closure is secured on a container, a stop projecting downwardly from the undersurface of said lip directly above the rim of a container when secured thereon and bearing on said disk, said channel communicating past said stop, said stop preventing said disk from closing said channel if said closure is overtightened on said container, said stop being positioned on said lip directly above the upper end of each said thread of said closure, a water outlet from the lower part of said threaded region, said water inlet channel, threaded region, and outlet providing an internal flow passage through which wash water can flow from said disk to said outlet, thereby to wash contaminants from said flow passage when said closure is secured on a container.

2. The closure of claim 1 wherein said skirt has downwardly extending channels on its inside surface, which conduct water flow downwardly past the periphery of said disk.

3. The closure of claim 1 wherein said water inlet channel is at least one radial slot in the undersurface of said top lip.

4. The closure of claim 1 wherein said top lip has a downwardly depending rim along an inner edge thereof, there being slots in said rim through which wash water impinging on said disk can enter said channel.

5. The closure of claim 1 further wherein said channel includes grooves on the inside of said shell, said grooves extending downwardly past the outer periphery of said disk and communicating with said spiral channel.

6. The closure of claim 1 wherein said insert disk has a flat peripheral portion which abuts said stop.

7. The closure of claim 1 wherein said disk is a bottom load disk.

* * * * *